US007845024B2

(12) United States Patent
Hill

(10) Patent No.: US 7,845,024 B2
(45) Date of Patent: Dec. 7, 2010

(54) PEACE OFFICER'S SHIRT AND SUSPENDER SET FOR SUPPORTING A DUTY BELT

(76) Inventor: Elton N. Hill, 1210 Talon Rd., Lincol, NE (US) 68505

( * ) Notice: Subject to any disclaimer, the term of this patent is extended or adjusted under 35 U.S.C. 154(b) by 152 days.

(21) Appl. No.: 12/291,410

(22) Filed: Nov. 10, 2008

(65) Prior Publication Data

US 2009/0070915 A1 Mar. 19, 2009

Related U.S. Application Data

(63) Continuation-in-part of application No. 11/879,094, filed on Jul. 16, 2007.

(51) Int. Cl.
*A41F 19/00* (2006.01)

(52) U.S. Cl. ..... 2/310; 2/312; 2/117

(58) Field of Classification Search ..... 2/310, 2/331, 117, 93, 94, 305, 320, 327, 106, 461, 2/69, 326, 2.5, 455; 224/576, 322
See application file for complete search history.

(56) References Cited

U.S. PATENT DOCUMENTS

| | | | | | |
|---|---|---|---|---|---|
| 770,761 | A | * | 9/1904 | Lemly | 224/649 |
| 1,335,927 | A | * | 4/1920 | Ainsworth | 2/310 |
| 1,398,962 | A | * | 12/1921 | Graves | 2/331 |
| 1,446,948 | A | * | 2/1923 | Taylor | 2/117 |
| 1,839,143 | A | * | 12/1931 | Ellis | 2/305 |
| 1,852,030 | A | * | 4/1932 | Shipman | 2/327 |
| 1,983,636 | A | * | 12/1934 | Palkens | 450/113 |
| 2,133,505 | A | * | 10/1938 | Green | 2/106 |
| 2,411,724 | A | * | 11/1946 | Hill | 51/298 |
| 2,682,669 | A | * | 7/1954 | Valentine et al. | 2/310 |
| 3,167,786 | A | * | 2/1965 | Johnson | 2/327 |
| 3,401,857 | A | * | 9/1968 | Wilson et al. | 224/637 |
| 4,923,105 | A | * | 5/1990 | Snyder | 224/255 |
| 5,214,806 | A | * | 6/1993 | Flores | 2/312 |
| 5,319,806 | A | * | 6/1994 | Hermann et al. | 2/461 |
| 5,413,262 | A | * | 5/1995 | Dewire et al. | 224/675 |
| 5,488,738 | A | * | 2/1996 | Seamans | 2/69 |
| 5,497,923 | A | * | 3/1996 | Pearson et al. | 224/639 |
| 5,611,079 | A | * | 3/1997 | Bain, III | 2/455 |
| 5,623,735 | A | | 4/1997 | Perry | |
| 6,021,528 | A | * | 2/2000 | Jurga et al. | 2/326 |
| 6,088,831 | A | * | 7/2000 | Jensen et al. | 2/2.5 |
| 6,216,931 | B1 | * | 4/2001 | Trawinski | 224/583 |
| 6,766,532 | B1 | * | 7/2004 | Cabana | 2/44 |
| 6,804,834 | B1 | | 10/2004 | Mok | |
| 6,959,455 | B2 | * | 11/2005 | Hall | 2/340 |
| 7,318,542 | B2 | * | 1/2008 | Godshaw et al. | 224/674 |
| D581,633 | S | * | 12/2008 | Seibold | D2/841 |
| 7,596,813 | B2 | * | 10/2009 | Borowski et al. | 2/93 |
| 2002/0112275 | A1 | * | 8/2002 | Hall | 2/310 |
| 2003/0110550 | A1 | * | 6/2003 | Guibord | 2/312 |
| 2006/0185056 | A1 | * | 8/2006 | Zwick | 2/115 |
| 2006/0289585 | A1 | * | 12/2006 | Godshaw et al. | 224/625 |
| 2009/0070915 | A1 | * | 3/2009 | Hill | 2/117 |

* cited by examiner

*Primary Examiner*—Katherine Moran
*Assistant Examiner*—Richale L Quinn
(74) *Attorney, Agent, or Firm*—Dennis L. Thomte; Thomte Patent Law Office LLC

(57) ABSTRACT

A suspender set and peace officer's shirt are described wherein the suspenders for the duty belt are located beneath the officer's shirt with only a portion of the suspender set extending outwardly through the front and rear of the shirt for connection to the duty belt worn by the officer.

5 Claims, 7 Drawing Sheets

PEACE OFFICER'S SHIRT AND SUSPENDER SET FOR SUPPORTING A DUTY BELT

CROSS REFERENCE TO RELATED APPLICATION

This is a continuation-in-part application of U.S. patent application Ser. No. 11/879,094 filed Jul. 16, 2007, entitled PEACE OFFICER'S SHIRT AND SUSPENDER SET FOR SUPPORTING A DUTY BELT.

BACKGROUND OF THE INVENTION

1. Field of the Invention

This invention relates to a peace officer's shirt and suspender set for supporting a duty belt and more particularly to a suspender set for supporting a duty belt which is positioned for the most part inside the shirt 2. Description of the Related Art Peace officers such as police officers, highway patrolmen, deputy sheriffs, etc., normally wear a duty belt which supports heavy gear such as a pistol, cartridges, pouches, radio, etc. The weight of the duty belt and the gear supported thereon is carried by the back of the officer and many officers have experienced severe back problems as a result of wearing the heavy duty belt. Suspenders could be used to support the duty belt, but the suspenders detract from the appearance of the officer's uniform. Further, if conventional suspenders are worn by the police officer to support the duty belt, a person involved in a fight or scuffle with the officer could grab the exposed suspenders to gain an unfair leverage or advantage over the officer during the fight or scuffle.

SUMMARY OF THE INVENTION

This Summary is provided to introduce a selection of concepts in a simplified form that are further described below in the Detailed Description. This Summary is not intended to identify key aspects or essential aspects of the claimed subject matter. Moreover, this Summary is not intended for use as an aid in determining the scope of the claimed subject matter.

A peace officer's shirt and suspender set for supporting a duty belt is disclosed wherein the suspenders are located primarily inside the shirt with only a small portion thereof extending through openings formed in the shirt for attachment to the duty belt. In one form of the invention, the suspender set is comprised of first and second flexible strap members which are length adjustable and which extend over the shoulders of the officer. Preferably, the suspenders slidably extend through shoulder pads which are releasably secured to Velcro® fasteners secured to the inside surface of the shirt above the shoulders of the officer. A buckle fastener is secured to each of the opposite ends of the first and second strap members and have belt loops secured thereto which may be extended through slits or openings formed in the front and rear sides of the shirt. The duty belt is extended through the belt loops so that the weight of the duty belt and gear supported thereon is carried by the shoulders rather than the back of the officer. In a second embodiment of the invention, the rearward ends of the first and second strap members are joined together with a single strap member extending downwardly from the juncture thereof through a single opening in the back of the officer's shirt. A modified form of the belt loops is also described which enables the belt loops to be disconnected from the duty belt without the need for removing the duty belt from the officer's waist. Preferably, the openings in the shirt are formed approximately one inch above the duty belt so that a minimum amount of the suspenders is exposed.

It is therefore a principal object of the invention to provide an improved peace officer's shirt and suspender set for supporting a duty belt.

A further object of the invention is to provide a device of the type described wherein the weight of the duty belt and the gear supported thereon is supported by the officer's shoulders rather than the officer's back.

Still another object of the invention is to provide a suspender set of the type described wherein the belt loops thereof may be opened so that the duty belt may be disconnected from the suspender set without removing the duty belt from the officer's waist.

A further object of the invention is to provide peace officer's shirt and suspender set for supporting a duty belt where only a small portion of the suspender set is exposed at the outer surface of the officer's shirt.

These and other objects will be obvious to those skilled in the art.

BRIEF DESCRIPTION OF THE DRAWINGS

Non-limiting and non-exhaustive embodiments of the present invention are described with reference to the following figures, wherein like reference numerals refer to like parts throughout the various views unless otherwise specified.

DESCRIPTION OF THE PREFERRED EMBODIMENT

Figure 1:
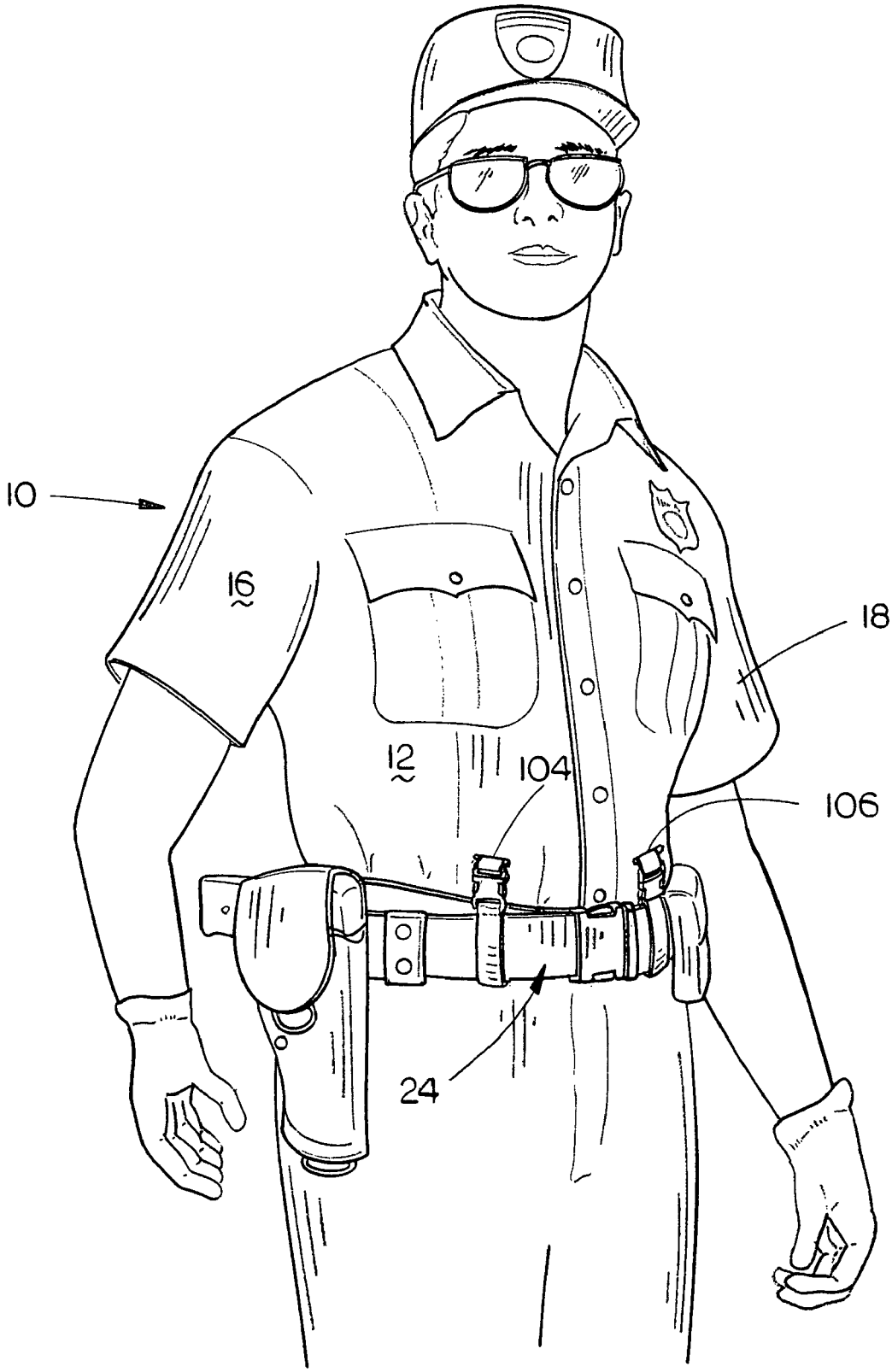
FIG. 1 is a perspective view illustrating a peace officer wearing a duty belt which is supported by the suspender set of this invention.
Figure 2:
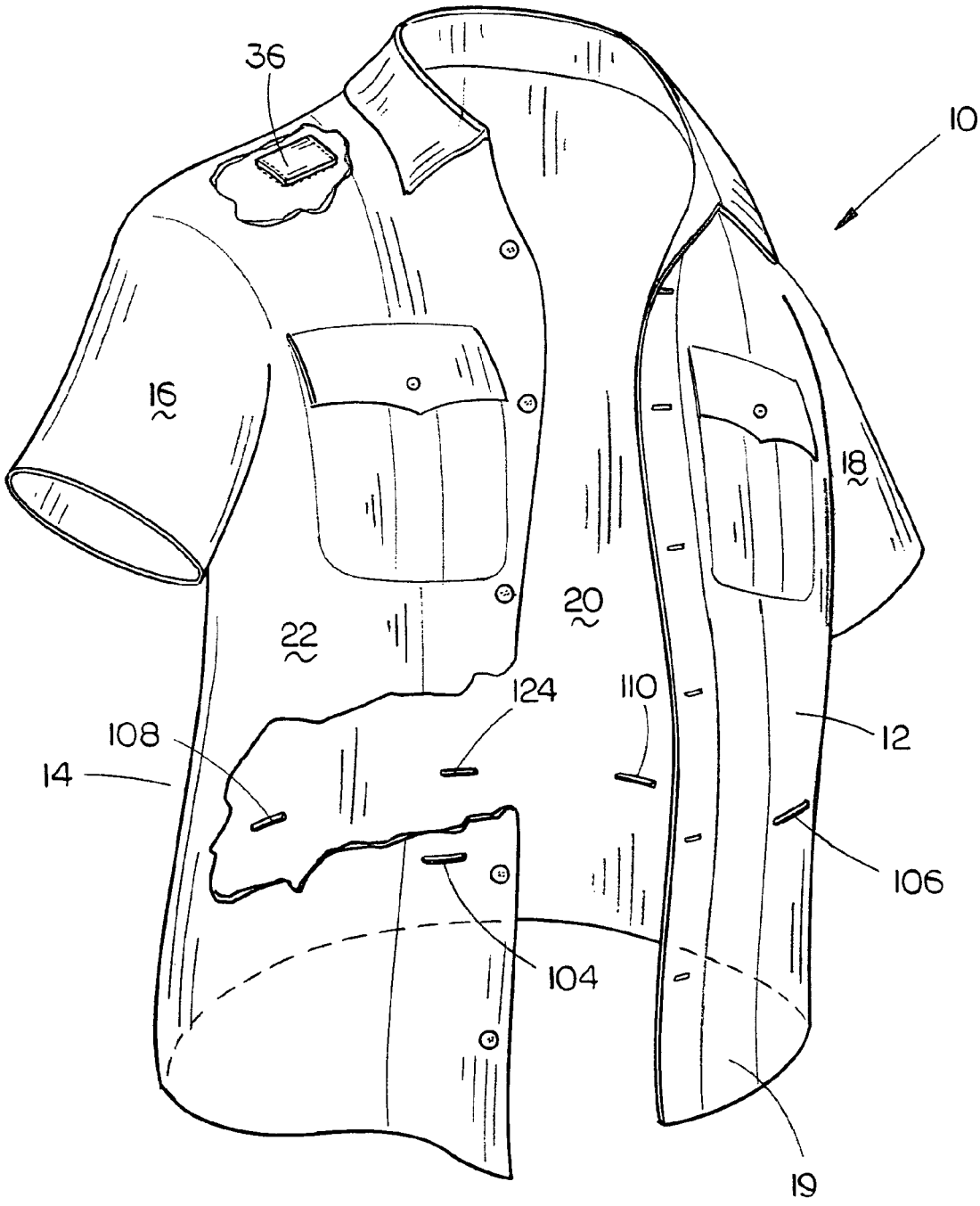
FIG. 2 is a partial perspective view of the shirt of this invention.

Embodiments are described more fully below with reference to the accompanying figures, which form a part hereof and show, by way of illustration, specific exemplary embodiments. These embodiments are disclosed in sufficient detail to enable those skilled in the art to practice the invention. However, embodiments may be implemented in many different forms and should not be construed as being limited to the embodiments set forth herein. The following detailed description is, therefore, not to be taken in a limiting sense in that the scope of the present invention is defined only by the appended claims.

The numeral 10 refers generally to a peace officers shirt having a front 12, a back 14, sleeves 16 and 18, with the tail 19 thereof being worn tucked into the officer's pants. The shirt 10 has an inner surface 20 and an outer surface 22.

Figure 3:
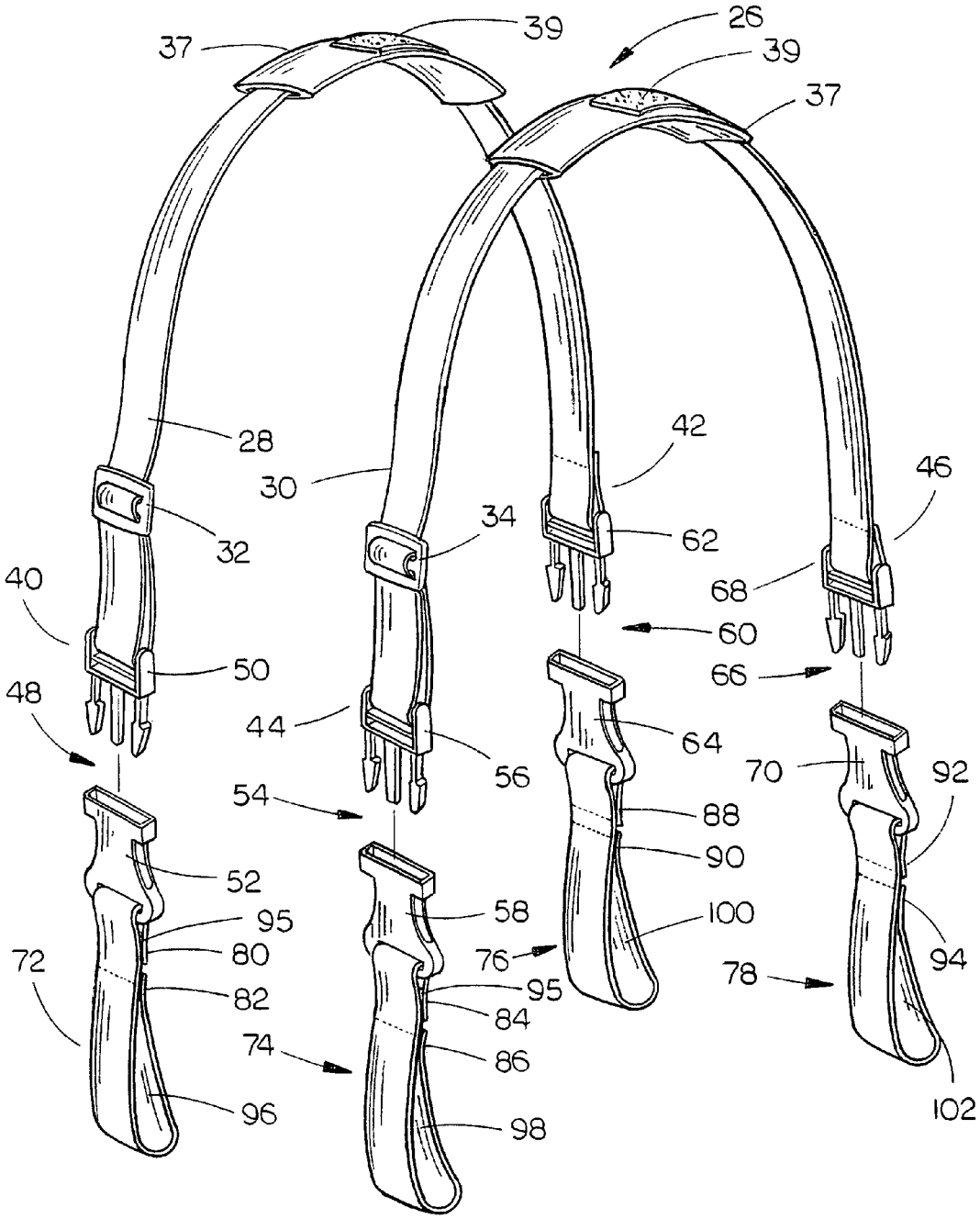
FIG. 3 is an exploded perspective view of one form of the suspender set of this invention.

The numeral 24 refers to a peace officer's duty belt of conventional design which is adapted to extend around the officer's waist and which supports heavy gear thereon such as cartridges, pistol, flashlight, handcuffs, etc. In FIG. 3, the numeral 26 refers to one embodiment of the suspender set of this invention which includes first and second flexible strap members 28 and 30, respectively. The strap members 28 and 30 are length adjustable by means of the sliding buckles 32 and 34, respectively. The suspender set 26 of this invention is intended to be worn under the officer's shirt and to extend over the officer's shoulders. It is preferred, but not necessary, that a pair of Velcre® strips 36 are sewn or otherwise secured to the inner surface 20 of the shirt so as to be positioned over the shoulders of the officer. Preferably, a pair of shoulder pads 37 are slidably mounted on the strap members 28 and 30 which have Velcro® 39 secured thereto which are releasably secured to the strips 36. For purposes of description, the first strap member will be described as having a front end 40 and a rear end 42 while the second strap member 30 will be described as having a front end 44 and a rear end 46.

The numeral 48 refers to a first buckle fastener having first and second buckle fastener members 50 and 52 which may be selectively fastened together in conventional fashion. The first buckle fastener member 50 of the buckle fastener 48 is secured to the front end 40 of the strap member 28. The numeral 54 designates a second buckle fastener having first and second buckle fastener members 56 and 58, respectively, which may be selectively fastened together in conventional fashion. The first buckle fastener member 56 of the buckle fastener 54 is secured to the front end 44 of the strap member 30.

The numeral 60 refers to a third buckle fastener including first and second buckle fastener members 62 and 64, respectively, which may be selectively fastened together in conventional fashion. The first buckle fastener member 62 of the buckle fastener 60 is secured to the rear end 42 of the strap member 28.

The numeral 66 refers to a fourth buckle fastener including first and second buckle fastener members 68 and 70, respectively, which may be selectively fastened together in conventional fashion. The first buckle fastener member 68 of the buckle fastener 66 is secured to the rear end 46 of the strap member 30. The buckle fastener members 48, 54, 60 and 66 are of conventional design and are commonly referred to as side-release buckle fasteners. The side-release buckle fasteners described herein are comprised of a plastic material and may be obtained from American Cord and Webbing of Woon Socket, R.I.

The numerals 72, 74, 76 and 78 refer to third, fourth, fifth and sixth flexible strap members, respectively, having first and second ends 80 and 82, 84 and 86, 88 and 90, and 92 and 94, respectively. The first ends of the third, fourth, fifth and sixth strap members are secured to the second buckle fastener members of the buckle fasteners 48, 54, 60 and 66, respectively, by hook and loop fasteners 95. The second ends of the third, fourth, fifth and sixth strap members 72, 74, 76 and 78 are secured to the strap members to define belt loops 96, 98, 100 and 102, respectively, adapted to have the duty belt extending therethrough so that a large portion of the weight of the duty belt is carried by the shoulders of the officer.

The shirt 10 has spaced-apart openings 104 and 106 formed in the front 12 thereof above the duty belt 24 so that the third and fourth strap members 72 and 74 may extend outwardly therethrough to the outer surface of the shirt. The shirt 10 also has third and fourth spaced-apart openings 108 and 110 formed in the back 14 thereof above the duty belt 24 so that the fifth and sixth strap member 76 and 78 may extend outwardly therethrough, respectively, to the outer surface of the shirt 10. Preferably, the openings 104, 106, 108 and 110 are formed in the shirt approximately one inch above the belt. Preferably, the duty belt 24 is black and the strap members 72, 74, 76 and 78 are also black so as to esthetically blend together.

Figure 6:
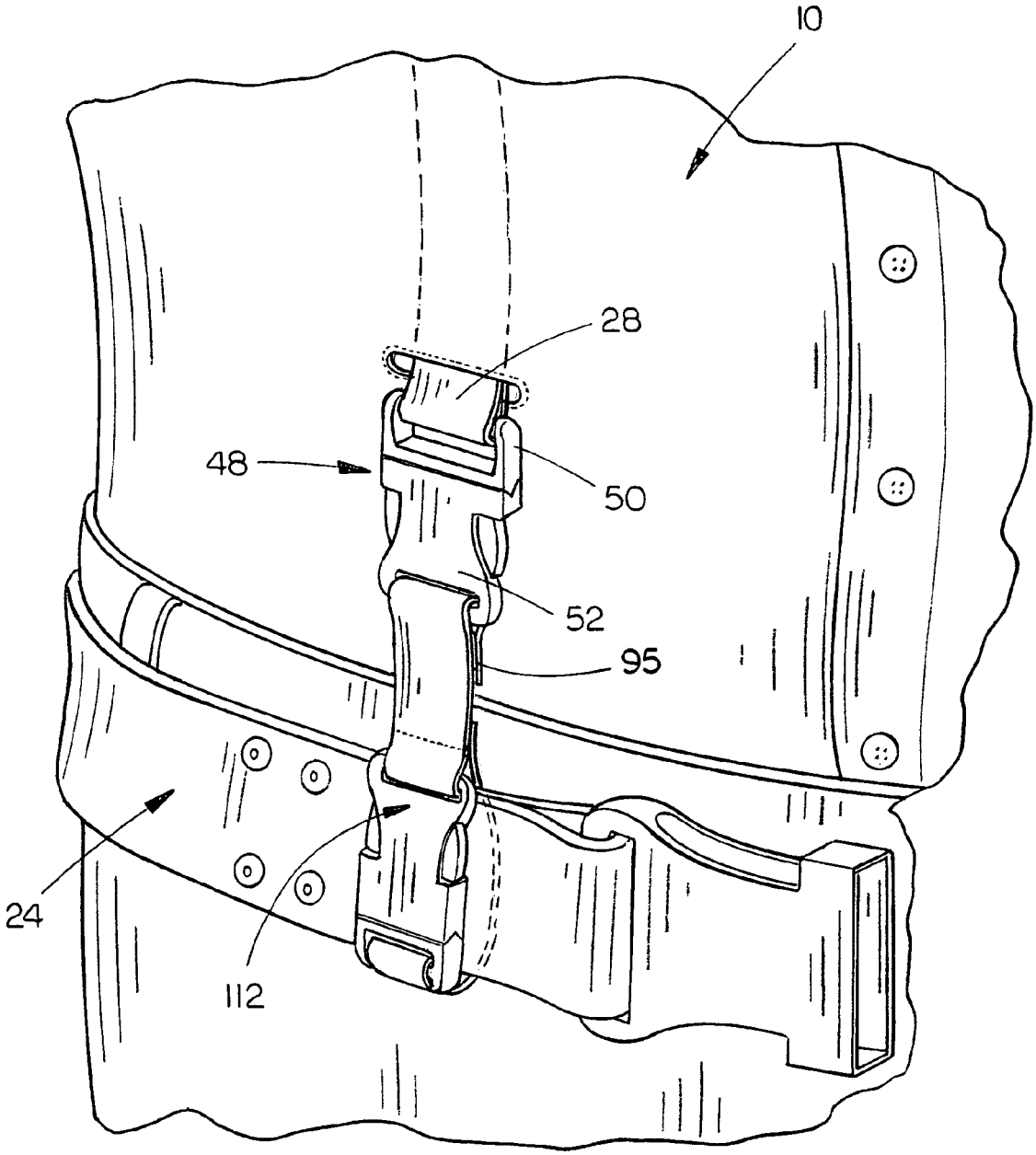
FIG. 6 is a view similar to FIG. 5 except that a modified form of the belt loop is utilized.
Figure 7:
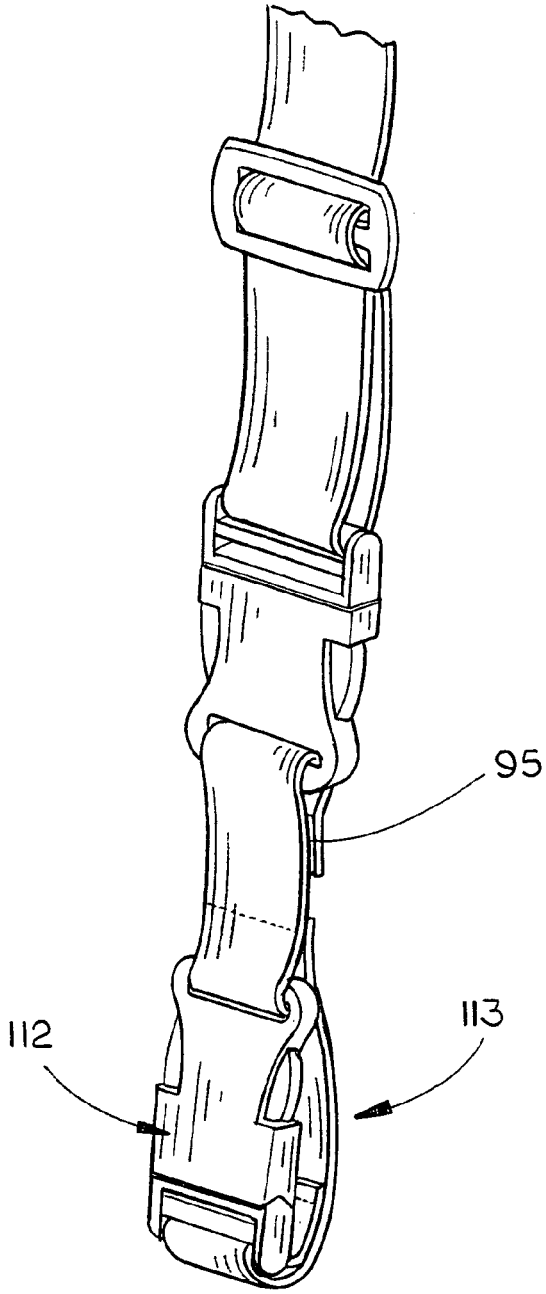
FIG. 7 is a perspective view of the modified loop in a closed position.
Figure 8:
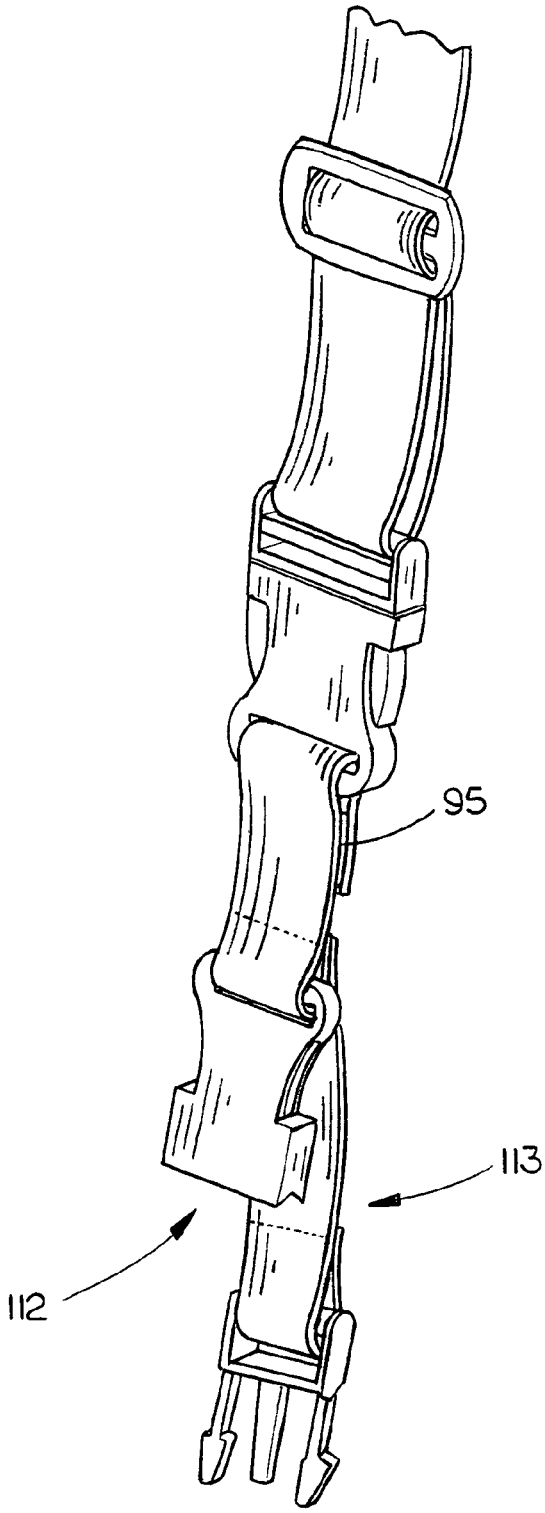
FIG. 8 is a view similar to FIG. 7 except that the belt loop has been opened.

The loops 96, 98, 100 and 102 on the strap members 72, 74, 76 and 78 are shown to be formed by stitching, however, the strap members 72, 74, 76 and 78 and the loops thereon may be replaced by the structure illustrated in FIGS. 6-8 so that the duty belt 24 may be disconnected from the suspender set without removing the duty belt from the officer's waist. As seen in FIGS. 6-8, the belt loop may be formed by including a buckle fastener 112 therein so that the loop may be opened. The buckle fastener is of the type described above and includes buckle fasteners member which are selectively connected together to form one side of the loop. The modified loop illustrated in FIGS. 6-8 is referred to generally by the reference numeral 113. As seen, the modified structure includes the hook and loop fasteners 95.

Figure 4:
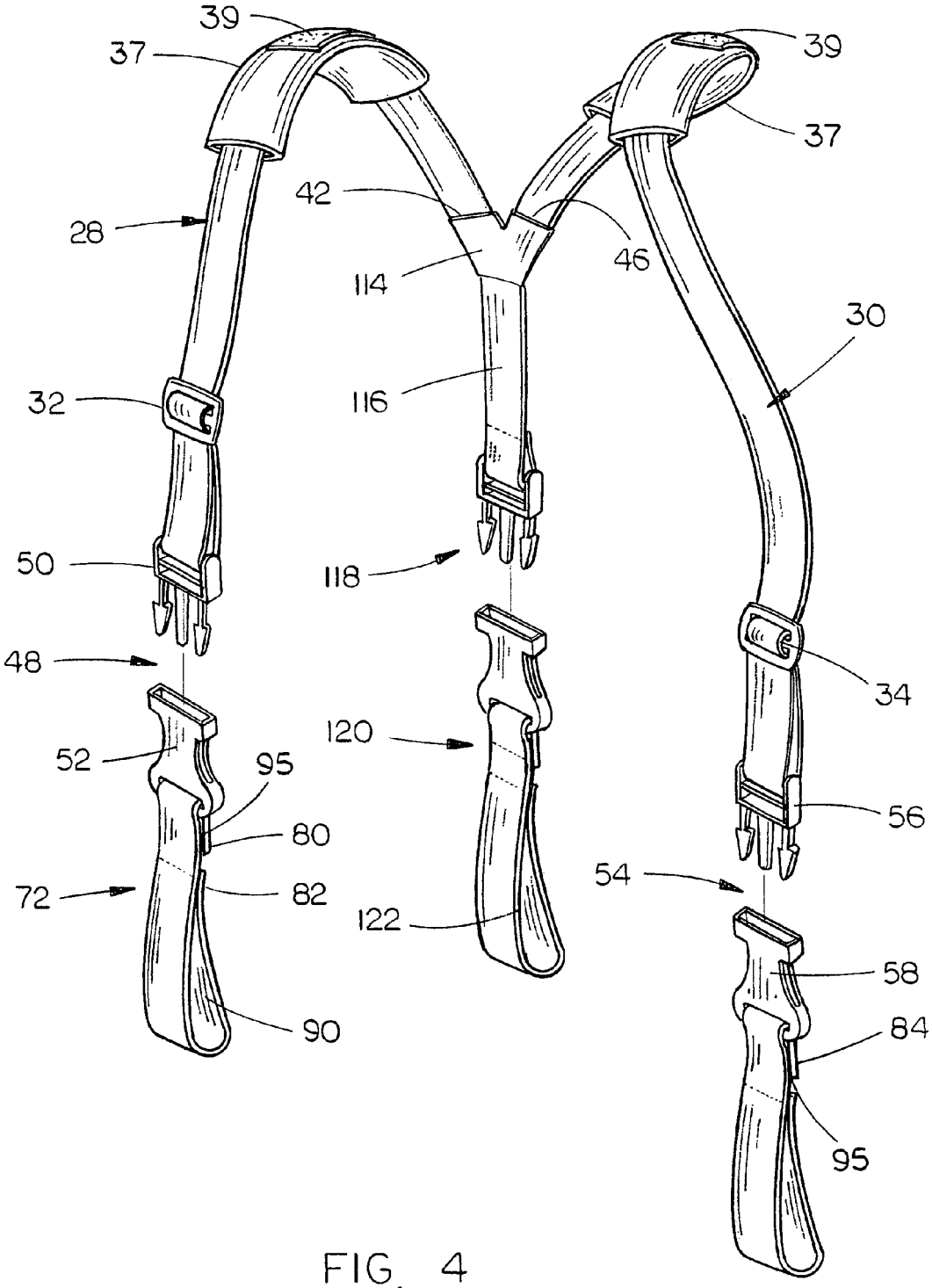
FIG. 4 is an exploded perspective view of a modified form of the suspender set of this invention.
Figure 5:
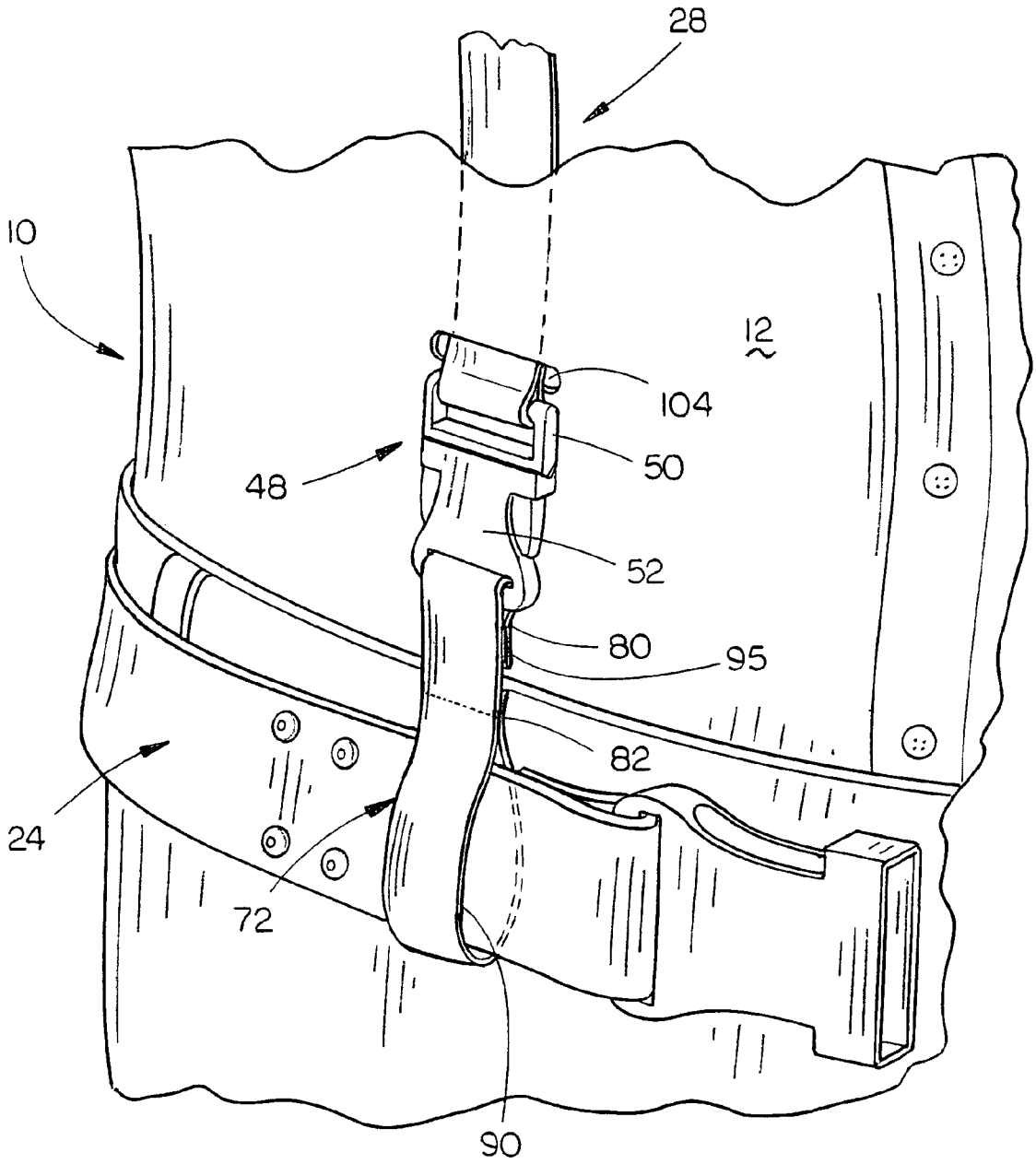
FIG. 5 is a partial perspective view illustrating the relationship of the first embodiment of this invention and the peace officer's duty belt.

Although it is preferred that there be four support points between the suspender set and the duty belt, it may be possible to have two support points at the front of the duty belt and only one support point at the rear end of the duty belt. FIG. 4 illustrates a structure wherein the rear end 42 of strap member 28 and the rear end 46 of strap member 30 are joined together at 114. A strap member 116 is secured at its upper end to the juncture 114 of strap members 28 and 30 and extends downwardly therefrom. A buckle fastener 118 of the type described hereinabove is secured to the lower end of strap member 116. Strap member 120 is secured at its upper end to the lower end of the buckle fastener 118 and has a belt loop 122 formed thereon. The belt loop 122 may be of either design described hereinabove. If the structure of FIG. 4 is used, there is only the need for a single opening 124 to be formed in the rear of the shirt to enable the strap member 120 to extend therethrough for connection to the duty belt.

Thus it can be seen that a novel suspender set and shirt have been provided which enables the weight of the duty belt to be carried by the shoulders of the officer rather than the back of the officer. The vast majority of the suspender set is located beneath the shirt so as not to detract from the appearance of the ensemble. Further, the fact that the majority of the suspender set is located beneath the shirt prevents a person from grabbing the same should the officer be involved in a scuffle or fight with a person. Only a small portion of the suspender set is exposed above the duty belt and is preferably the same color as the belt so as to blend therein. The buckle fasteners described herein enable the suspender set to be quickly and easily attached to the duty belt and detached therefrom.

The shoulder pads 37 provide additional comfort to the wearer and permit the straps associated therewith to slidably move therethrough to prevent binding between the straps and the shirt.

The use of the hook and loop fastener 95 on the structure permits the associated loop to "break-away" so that if a person attempts to grasp the same during an altercation, the shoulder straps will disconnect from the belt loop thereby denying the person being apprehended from gaining a firm grasp of the structure.

Thus it can be seen that the invention accomplishes at least all of the stated objectives.

Although the invention has been described in language that is specific to certain structures and methodological steps, it is to be understood that the invention defined in the appended claims is not necessarily limited to the specific structures and/or steps described. Rather, the specific aspects and steps are described as forms of implementing the claimed invention. Since many embodiments of the invention can be practiced without departing from the spirit and scope of the invention, the invention resides in the claims hereinafter appended.

The invention claimed is:

1. In combination:

a peace officer's shirt having a front, a back, sleeves, and a tail which is worn tucked into the wearer's pants, said shirt having an inner surface and an outer surface;

a peace officer's duty belt extending around the officer's waist which supports heavy gear;

a suspender set comprising first and second flexible strap members;

said suspender set intended to be worn under the officer's shirt and to extend over the officer's shoulders;

each of said first and second strap members having a front end and a rear end;

a first buckle fastener including first and second buckle fastener members which may be selectively fastened together;

said first buckle fastener member of said first buckle fastener means being secured to said front end of said first strap member;

a second buckle fastener including first and second buckle fastener members which may be selectively fastened together;

said first buckle fastener member of said second buckle fastener being secured to said front end of said second strap member;

a third buckle fastener including first and second buckle fastener members which may be selectively fastened together;

said first buckle fastener member of said third buckle fastener being secured to said rear end of said first strap member;

a fourth buckle fastener including first and second buckle fastener members which may be selectively fastened together;

said first buckle fastener member of said fourth buckle fastener being secured to said rear end of said second strap member;

third, fourth, fifth and sixth flexible strap members having first and second ends;

said first ends of said third, fourth, fifth and sixth strap members being secured to said second buckle fastener members of said first, second, third and fourth buckle fasteners in a "break-away" fashion, respectively;

said shirt having first and second spaced-apart openings formed in said front thereof above said duty belt so that said third and fourth strap members may extend outwardly therethrough to said outer surface of said shirt;

said shirt having third and fourth spaced-apart openings formed in said back thereof above said duty belt so that said fifth and sixth strap members may extend outwardly therethrough to said outer surface of said shirt;

each of said second ends of said third, fourth, fifth and sixth strap members having a belt loop thereon adapted to have said duty belt extending therethrough so that at least some of the weight of said duty belt is carried by the shoulders of the officer;

said inner surface of said shirt having first and second hook and loop fastener strips secured thereto which are positioned above the shoulders of the officer, said first and second strap members extending through shoulder pads which are releasably secured to said strips.

2. In combination:

a peace officer's shirt having a front, a back, sleeves, and a tail which is worn tucked into the wearers pants, said shirt having an inner surface and an outer surface;

a peace officer's duty belt extending around the officer's waist which supports heavy gear;

a suspender set comprising first and second flexible strap members;

said suspender set intended to be worn under the officer's shirt and to extend over the officer's shoulders;

each of said first and second strap members having a front end and a rear end;

a first buckle fastener including first and second buckle fastener members which may be selectively fastened together;

said first buckle fastener member of said first buckle fastener means being secured to said front end of said first strap member;

a second buckle fastener including first and second buckle fastener members which may be selectively fastened together;

said first buckle fastener member of said second buckle fastener being secured to said front end of said second strap member;

a third buckle fastener including first and second buckle fastener members which may be selectively fastened together;

said first buckle fastener member of said third buckle fastener being secured to said rear end of said first strap member;

a fourth buckle fastener including first and second buckle fastener members which may be selectively fastened together;

said first buckle fastener member of said fourth buckle fastener being secured to said rear end of said second strap member;

third, fourth, fifth and sixth flexible strap members having first and second ends;

said first ends of said third, fourth, fifth and sixth strap members being secured to said second buckle fastener members of said first, second, third and fourth buckle fasteners in a "break-away" fashion, respectively;

said shirt having first and second spaced-apart openings formed in said front thereof above said duty belt so that said third and fourth strap members may extend outwardly therethrough to said outer surface of said shirt;

said shirt having third and fourth spaced-apart openings formed in said back thereof above said duty belt so that said fifth and sixth strap members may extend outwardly therethrough to said outer surface of said shirt;

each of said second ends of said third, fourth, fifth and sixth strap members having a belt loop thereon adapted to have said duty belt extending therethrough so that at least some of the weight of said duty belt is carried by the shoulders of the officer;

each of said belt loops being selectively openable to permit said belt loops to be disengaged from said duty belt;

each of said belt loops including a buckle fastener including first and second buckle fastener members which may be selectively fastened together.

3. In combination:

a peace officer's shirt having a front, a back, sleeves, and a tail which is worn tucked into the officers pants, said shirt having an inner surface and an outer surface;

a peace officer's duty belt extending around the officers waist and which supports heavy gear;

a suspender set comprising first and second flexible strap members having front and rear ends;

said suspender set intended to be worn under the officer's shirt and to extend over the officers shoulders;

a first buckle fastener including first and second buckle fastener members which may be selectively fastened together;

said first buckle fastener member of said first buckle fastener means being secured to said front end of said first strap member;

a second buckle fastener including first and second buckle fastener members which may be selectively fastened together;

said first buckle fastener member of said second buckle fastener being secured to said front end of said second strap member;

said rear ends of said first and second strap members being operatively joined together;

a third flexible strap having upper and lower ends;

said upper end of said third strap member being secured to the juncture of said rear ends of said first and second strap members and extending downwardly therefrom;

a third buckle fastener including first and second buckle fastener members which may be selectively fastened together;

said first end of said third buckle fastener being secured to said lower end of said third strap member;

fourth and fifth flexible strap members having first and second ends;

said first ends of said fourth and fifth strap members being secured to said second buckle fastener members of said first and second buckle fasteners in a break-away manner, respectively;

a sixth flexible strap member having first and second ends;

said first end of said sixth strap member being secured to said second buckle fastener of said third buckle fastener;

said shirt having first and second spaced-apart openings formed in said front thereof above said duty belt so that said fourth and fifth strap members may extend outwardly therethrough to said outer surface of said shirt;

said shirt having a third opening formed in said back thereof above said duty belt so that said sixth strap member may extend outwardly therethrough to said outer surface of said shirt;

each of said second ends of said fourth and fifth strap members and said lower end of said sixth strap member having a belt loop thereon adapted to have said duty belt extending therethrough so that at least some of the weight of said duty belt is carried by the shoulders of the officer;

said inner surface of said shirt having first and second hook and loop fastener strips secured thereto which are positioned above the shoulders of the officer, said first and second straps extending through shoulder pads which are releasably secured to said strips.

4. In combination:

a peace officer's shirt having a front, a back, sleeves, and a tail which is worn tucked into the officer's pants, said shirt having an inner surface and an outer surface;

a peace officer's duty belt extending around the officer's waist and which supports heavy gear;

a suspender set comprising first and second flexible strap members having front and rear ends;

said suspender set intended to be worn under the officers shirt and to extend over the officer's shoulders;

a first buckle fastener including first and second buckle fastener members which may be selectively fastened together;

said first buckle fastener member of said second first buckle fastener means being secured to said front end of said first strap member;

a second buckle fastener including first and second buckle fastener members which may be selectively fastened together;

said first buckle fastener member of said second buckle fastener being secured to said front end of said second strap member;

said rear ends of said first and second strap members being operatively joined together;

a third flexible strap having upper and lower ends;

said upper end of said third strap member being secured to the juncture of said rear ends of said first and second strap members and extending downwardly therefrom;

a third buckle fastener including first and second buckle fastener members which may be selectively fastened together;

said first end of said third buckle fastener being secured to said lower end of said third strap member;

fourth and fifth flexible strap members having first and second ends;

said first ends of said fourth and fifth strap members being secured to said second buckle fastener members of said first and second buckle fasteners in a break-away manner, respectively;

a sixth flexible strap member having first and second ends;

said first end of said sixth strap member being secured to said second buckle fastener of said third buckle fastener;

said shirt having first and second spaced-apart openings formed in said front thereof above said duty belt so that said fourth and fifth strap members may extend outwardly therethrough to said outer surface of said shirt;

said shirt having a third opening formed in said back thereof above said duty belt so that said sixth strap member may extend outwardly therethrough to said outer surface of said shirt;

each of said second ends of said fourth and fifth strap members and said lower end of said sixth strap member having a belt loop thereon adapted to have said duty belt extending therethrough so that at least some of the weight of said duty belt is carried by the shoulders of the officer;

each of said belt loops being selectively openable to permit said belt loops to be disengaged from said duty belt;

each of said belt loops including a buckle fastener including first and second buckle fastener members which may be selectively fastened together.

5. In combination:

a peace officer's shirt having a front, a back, sleeves, and a tail which is worn tucked into the wearer's pants, said shirt having an inner surface and an outer surface;

a peace officer's duty belt extending around the officer's waist which supports gear thereon;

a suspender set comprising first and second flexible strap members;

said suspender set intended to be worn under the officer's shirt and to extend over the officer's shoulders;

each of said first and second strap members having a front end and a rear end;

a first belt loop at said front end of said first strap member;

a second belt loop at said front end of said second strap member;

a third belt loop at said rear end of said first strap member;

a fourth belt loop at said rear end of said second strap member;

said shirt having first and second spaced-apart openings formed in said front thereof above said duty belt so that said first and second belt loops may extend outwardly therethrough to said outer surface of said shirt;

said shirt having third and fourth spaced-apart openings formed in said back thereof above said duty belt so that said third and fourth belt loops may extend outwardly therethrough to said outer surface of said shirt;

said belt loops adapted to have said duty belt extending therethrough so that at least some of the weight of said duty belt is carried by the shoulders of the officer;

said inner surface of said shirt having first and second hook and loop fastener strips secured thereto which are positioned above the shoulders of the officer, said first and second strap members extending through shoulder pads which are releasably secured to said strips.

* * * * *